US009133609B2

(12) United States Patent
Blaine

(10) Patent No.: US 9,133,609 B2
(45) Date of Patent: Sep. 15, 2015

(54) MOUNTING DRIVER FOR UNDERMOUNTED SINKS

(71) Applicant: Dow Blaine, Suwanee, GA (US)

(72) Inventor: Dow Blaine, Suwanee, GA (US)

( * ) Notice: Subject to any disclaimer, the term of this patent is extended or adjusted under 35 U.S.C. 154(b) by 52 days.

(21) Appl. No.: 14/095,461

(22) Filed: Dec. 3, 2013

(65) Prior Publication Data

US 2015/0108308 A1 Apr. 23, 2015

Related U.S. Application Data

(60) Provisional application No. 61/894,748, filed on Oct. 23, 2013.

(51) Int. Cl.

| | |
|---|---|
| ***E03C 1/32*** | (2006.01) |
| ***E03C 1/33*** | (2006.01) |
| ***F16B 9/02*** | (2006.01) |
| ***A47B 77/06*** | (2006.01) |
| ***A47K 1/05*** | (2006.01) |

(52) U.S. Cl.

CPC ..... *E03C 1/335* (2013.01); *A47B 77/06* (2013.01); *A47K 1/05* (2013.01); *F16B 9/026* (2013.01); *E03C 1/32* (2013.01); *E03C 1/33* (2013.01)

(58) Field of Classification Search

CPC ..... E03C 1/335; E03C 1/33; F16B 9/026; F16B 9/02; F16B 9/00

USPC ..... 248/251; 4/632, 633, 634, 695

See application file for complete search history.

(56) References Cited

U.S. PATENT DOCUMENTS

| | | | | |
|---|---|---|---|---|
| 1,253,924 | A * | 1/1918 | Barnett | 248/241 |
| 2,846,695 | A * | 8/1958 | Hartog | 4/633 |
| 3,022,519 | A | 2/1959 | Lang | |
| 3,229,310 | A * | 1/1966 | Ensch | 4/636 |
| 3,365,732 | A * | 1/1968 | Juergens et al. | 4/634 |
| 3,412,727 | A * | 11/1968 | Hurko | 126/211 |
| 4,432,106 | A | 2/1984 | Smith | |
| 4,504,986 | A * | 3/1985 | Vigh | 4/633 |
| 4,613,995 | A * | 9/1986 | Ricke | 4/634 |
| 5,014,371 | A | 5/1991 | Heel | |
| 5,538,206 | A | 7/1996 | Sather | |
| 5,664,265 | A * | 9/1997 | Gotter et al. | 4/634 |
| 5,743,501 | A | 4/1998 | Rapp | |
| 5,911,521 | A | 6/1999 | Steinmetz et al. | |
| 7,429,021 | B2 | 9/2008 | Sather et al. | |
| 7,698,753 | B2 | 4/2010 | Jones et al. | |
| 8,070,110 | B2 | 12/2011 | Jones et al. | |
| 8,146,873 | B2 | 4/2012 | Johnson | |
| 8,166,618 | B2 | 5/2012 | Eriksson | |
| 8,356,367 | B2 | 1/2013 | Flynn | |
| 2008/0313804 | A1 * | 12/2008 | Osterroth et al. | 4/695 |
| 2010/0301175 | A1 * | 12/2010 | Grayson | 248/27.1 |
| 2012/0222213 | A1 | 9/2012 | Booth et al. | |

* cited by examiner

*Primary Examiner* — Mark Wendell

(74) *Attorney, Agent, or Firm* — Welsh Flaxman & Gitler LLC

(57) ABSTRACT

A mounting driver for undermounting a sink to a support surface includes a support bar shaped and dimensioned for positioning between an underside of the sink and a wall of a cabinet at an angular orientation relative to the wall. The support bar includes a first end and a second end. The mounting driver also includes a mounting bracket shaped and dimensioned for fixed attachment to the wall of the cabinet, the mounting bracket including a recess shaped and dimensioned to receive the second end of support bar. With the first end of the support bar pressed against the underside of the sink, the second end of the support bar is secured within the mounting bracket rigidly secured to the wall of the cabinet.

20 Claims, 8 Drawing Sheets

MOUNTING DRIVER FOR UNDERMOUNTED SINKS

CROSS REFERENCE TO RELATED APPLICATION

This application claims the benefit of U.S. Provisional Patent Application Ser. No. 61/894,748, entitled "MOUNTING DRIVER FOR UNDERMOUNTED SINKS," filed Oct. 23, 2013.

BACKGROUND OF THE INVENTION

1. Field of the Invention

The present application is directed to an undermounting system for a sink.

2. Description of the Related Art

Undermounting of sinks fully beneath the surface of a countertop has become very popular based upon the aesthetics of a countertop that is unencumbered with the rim of a sink. In addition, and without the rim of the sink mounted upon the upper surface of a countertop, there is no seam between the rim and the countertop in which dirt and grime may accumulate.

However, the ability to securely support a sink positioned beneath a granite countertop is very limited as one cannot simply screw the sink to the underside of the countertop. With this in mind, a need continues to exist for a sink supporting structure allowing for secure and stable support of the sink without the need for elaborate and expensive mounting structures.

SUMMARY OF THE INVENTION

It is, therefore, an object of the present invention to provide a mounting driver for undermounting a sink to a support surface. The mounting driver includes a support bar shaped and dimensioned for positioning between an underside of the sink and a wall of a cabinet at an angular orientation relative to the wall. The support bar includes a first end and a second end. The mounting driver also includes a mounting bracket shaped and dimensioned for fixed attachment to the wall of the cabinet, the mounting bracket including a recess shaped and dimensioned to receive the second end of the support bar. With the first end of the support bar pressed against the underside of the sink, the second end of the support bar is secured within the mounting bracket rigidly secured to the wall of the cabinet.

It is also an object of the present invention to provide a mounting driver wherein the support bar is an elongated member including a central support body having an I-beam construction.

It is another object of the present invention to provide a mounting driver wherein the support bar is an elongated member including a central support body and the first end of the support bar includes a sink engaging member.

It is a further object of the present invention to provide a mounting driver wherein the sink engaging member includes a curved surface shaped and dimensioned to engage the underside of the sink.

It is also an object of the present invention to provide a mounting driver wherein the sink engaging member includes a long axis greater than a width of the central support body.

It is another object of the present invention to provide a mounting driver wherein the support bar includes a tapered outward transition between the central support body and the sink engaging member.

It is a further object of the present invention to provide a mounting driver wherein the second end of the support bar includes a rounded distal end.

It is also an object of the present invention to provide a mounting driver wherein the support bar tapers inwardly with respect to a length of the central support body as it extends to the second end of the support bar.

It is another object of the present invention to provide a mounting driver wherein the mounting bracket is substantially U-shaped.

It is a further object of the present invention to provide a mounting driver wherein the mounting bracket includes a wall engaging surface and an exposed surface.

It is also an object of the present invention to provide a mounting driver wherein the mounting bracket includes a first leg, a second leg, and a connecting member connecting the first leg to the second leg in a manner defining a recess shaped and dimensioned to receive the second end of the support bar.

It is another object of the present invention to provide a mounting driver wherein the mounting bracket also includes screw holes laterally extending therethrough.

It is a further object of present invention to provide a mounting driver for undermounting a sink to a support surface including a support bar shaped and dimensioned for positioning between an underside of the sink and a wall of a cabinet at an angular orientation relative to the wall, the support bar including a first end and a second end. The second end of the support bar is curved such that a back surface cap member of the support bar defines a concave surface along a back side of the support bar, and extending through the back surface cap member are a plurality of holes formed along the length of the second end of the support bar. With the first end of the support bar pressed against the underside of the sink, the second end of the support bar is rigidly secured to the wall of the cabinet.

It is also an object of the present invention to provide a method for undermounting a sink to a countertop. The method includes positioning a sink along a lower surface of a countertop and positioning a mounting driver between a rim of the sink and a wall of a cabinet upon which the countertop is mounted. The mounting driver includes a support bar and a mounting bracket, wherein the support bar includes a first end and a second end and the mounting bracket includes a recess shaped and dimensioned to receive the second end of the support bar. The method includes securing the mounting bracket to the wall of the cabinet in a position adjacent to the sink to create a secure supporting structure for the sink.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
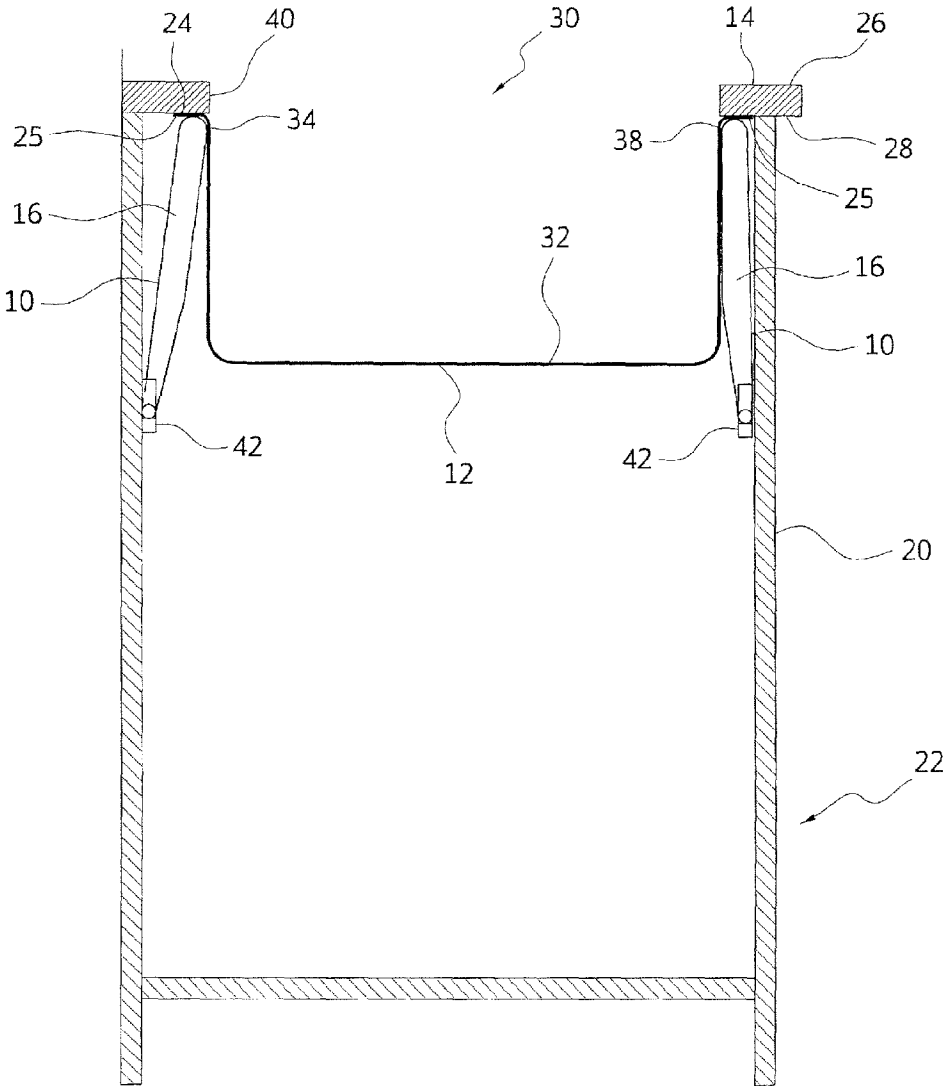
FIGS. 1 and 2 are sectional views respectively from the front of the sink and the side of the sink showing a sink undermounted to a countertop using the mounting driver in accordance with the present invention.
Figure 2:
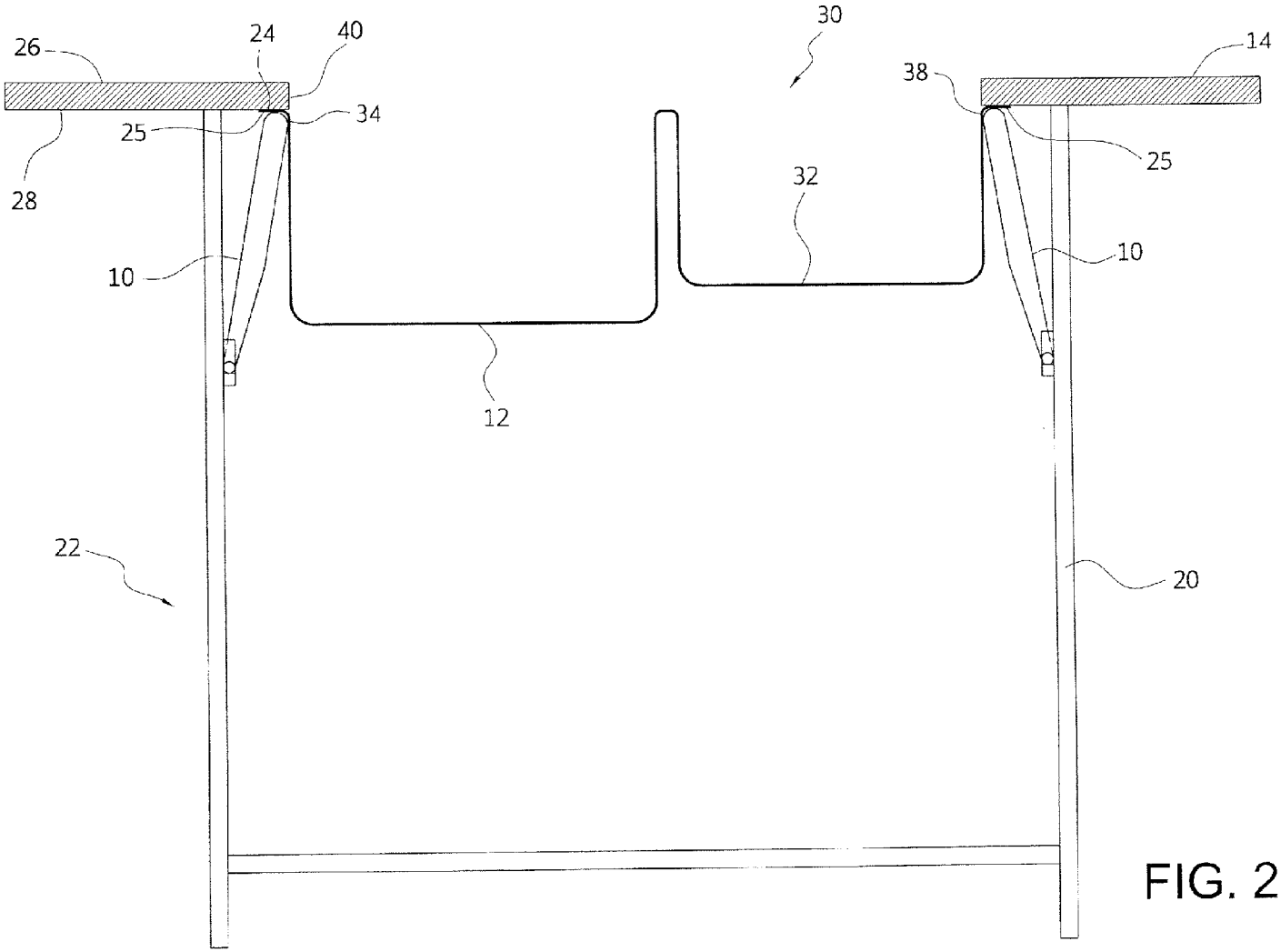
Figure 3:
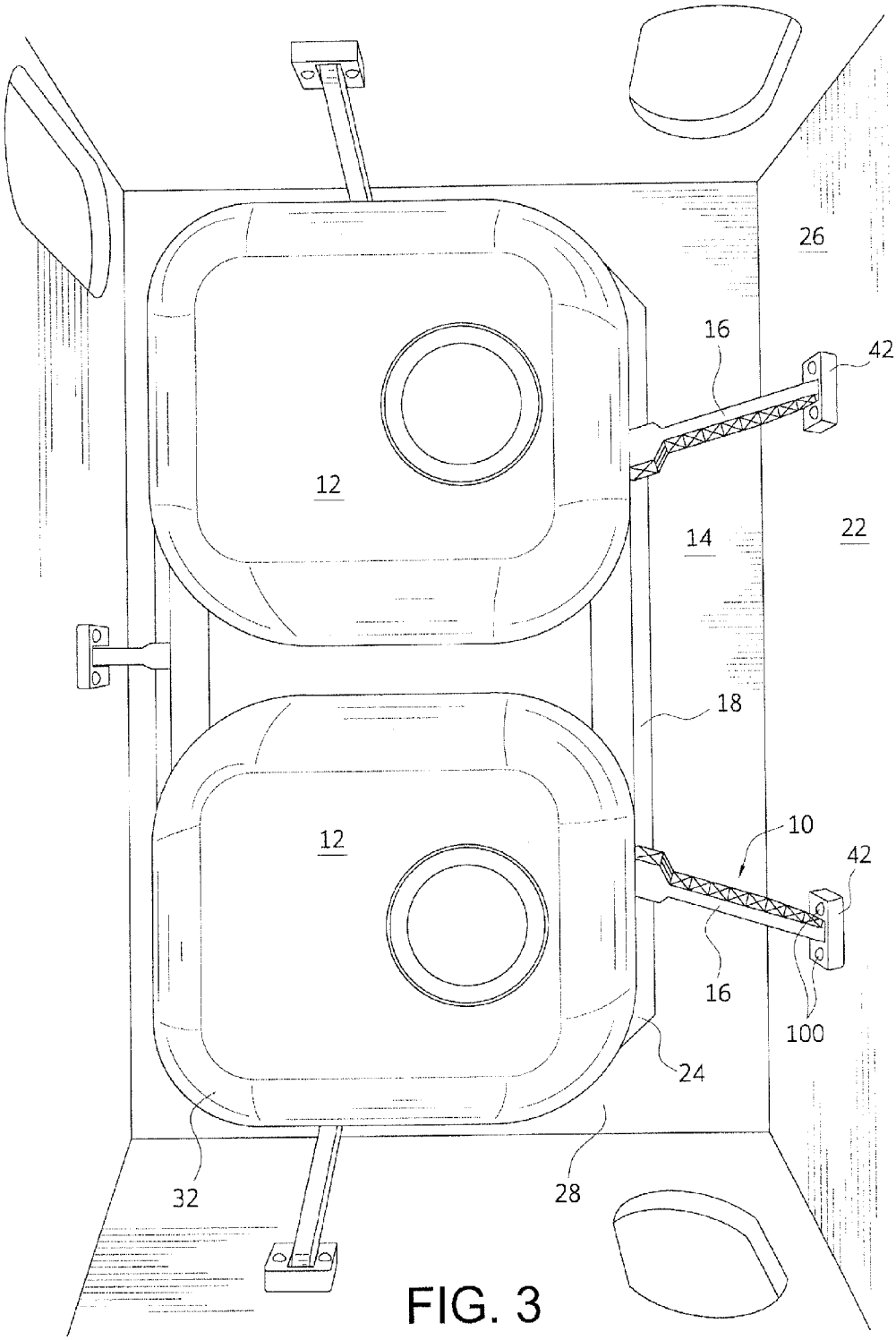
FIG. 3 is a bottom plan view of the sink undermounted to the countertop using the mounting driver in accordance with the present invention.
Figure 4:
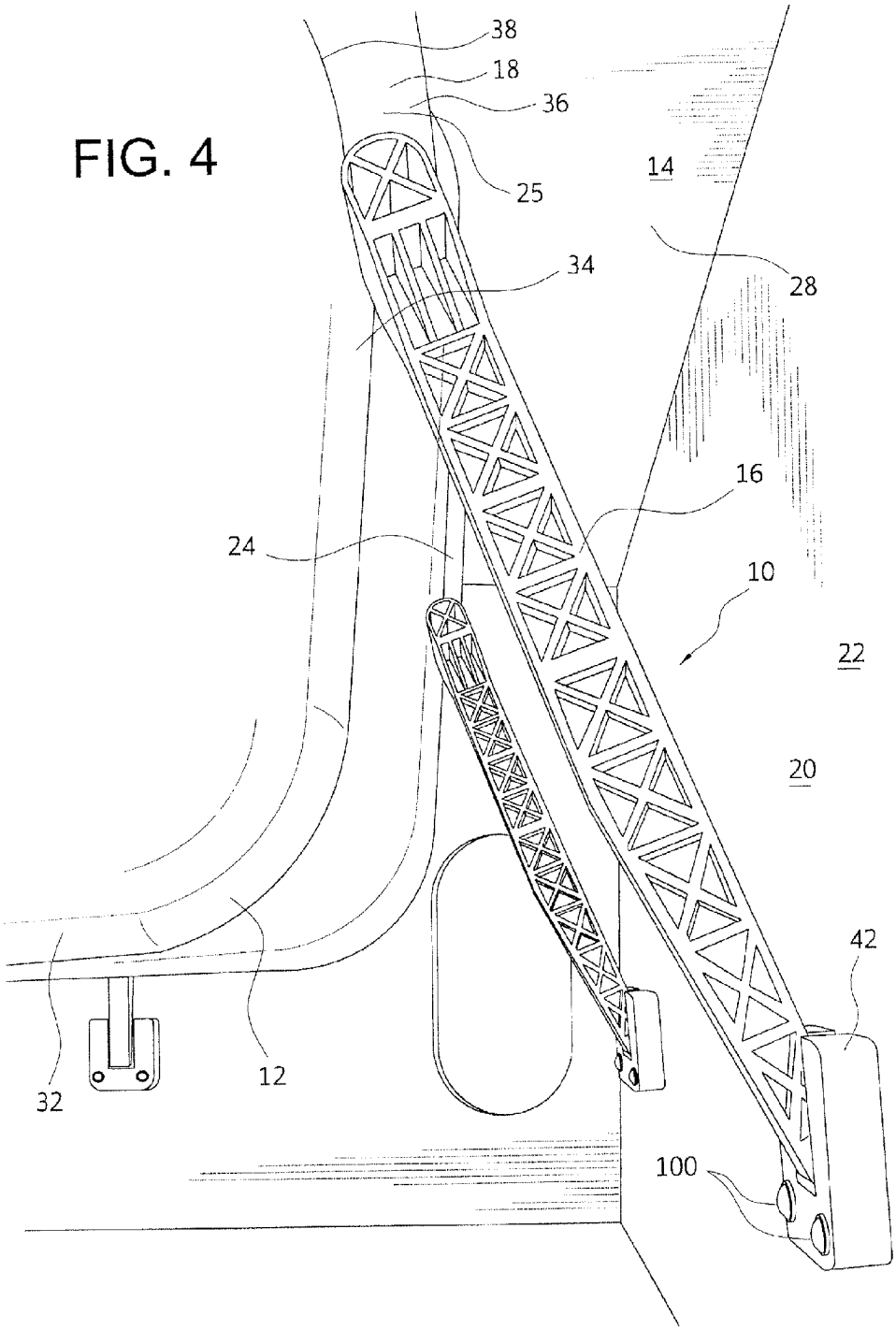
FIG. 4 is a detailed side view of the sink undermounted to the countertop using the mounting driver in accordance with the present invention.
Figure 5:
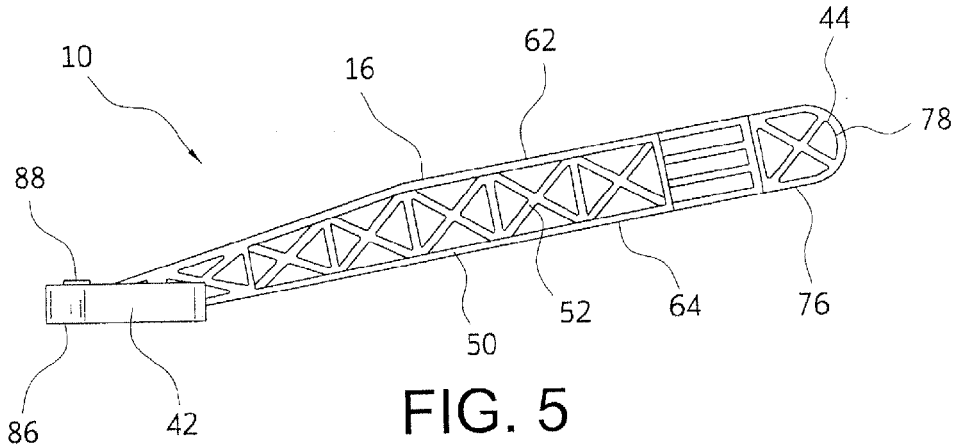
FIGS. 5, 6, and 7 are respectively a side view, a top plan view and a perspective view of the mounting driver in accordance with the present invention.
Figure 6:
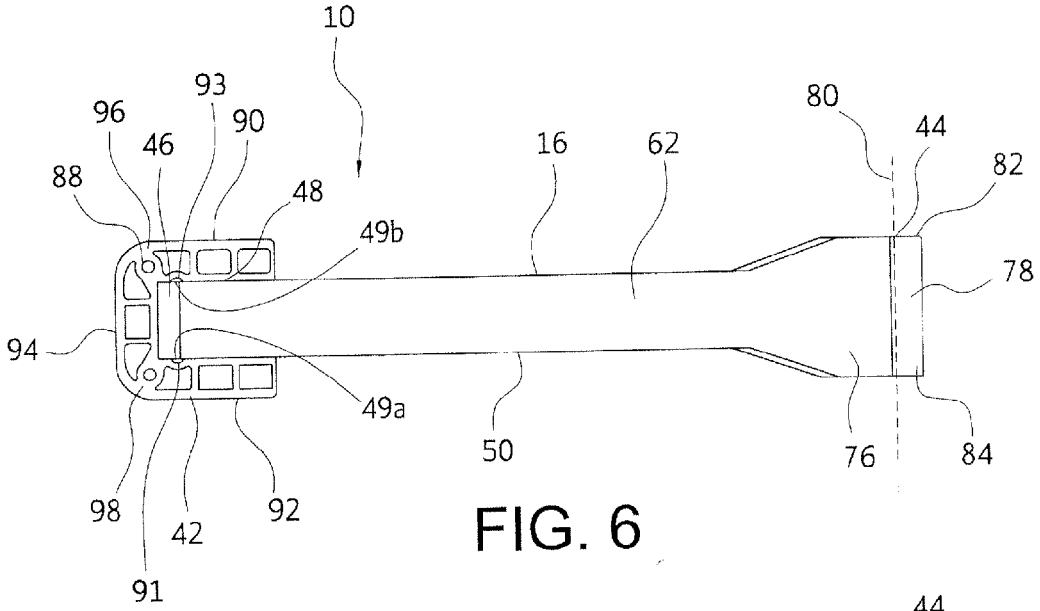
Figure 7:
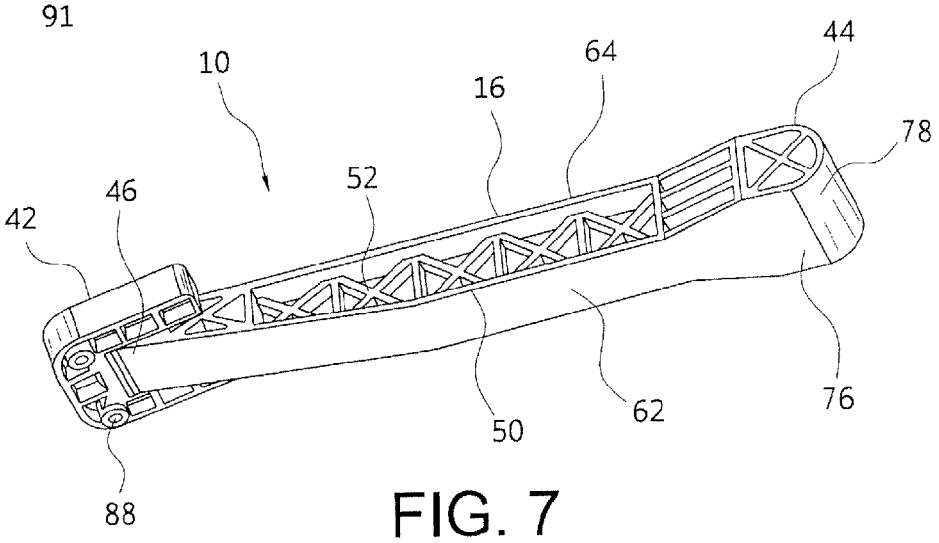
Figure 8:
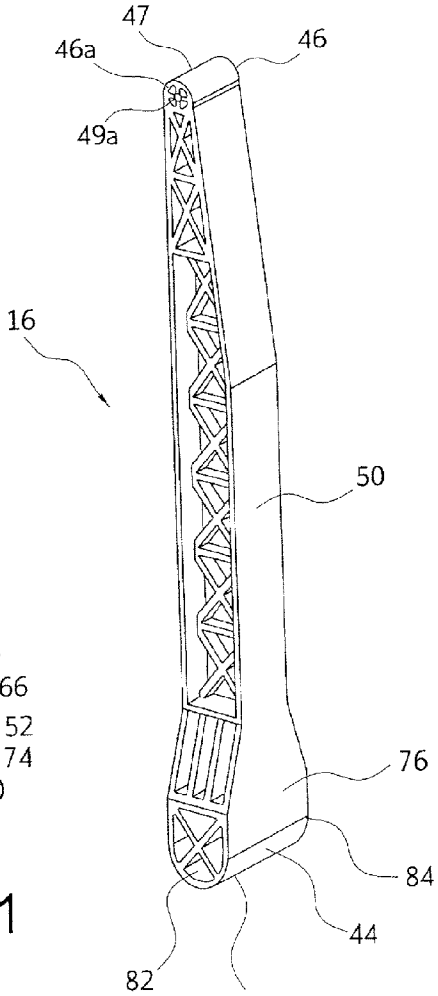
FIGS. 8, 9, 10, and 11 are respectively a perspective view, a top cross-sectional view along the line 9-9 in FIG. 10, a side view and a lateral cross sectional view along the line 11-11 in FIG. 10 of the mounting driver in accordance with the present invention.
Figure 11:
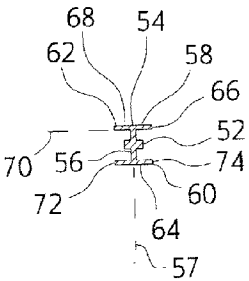
Figure 9:
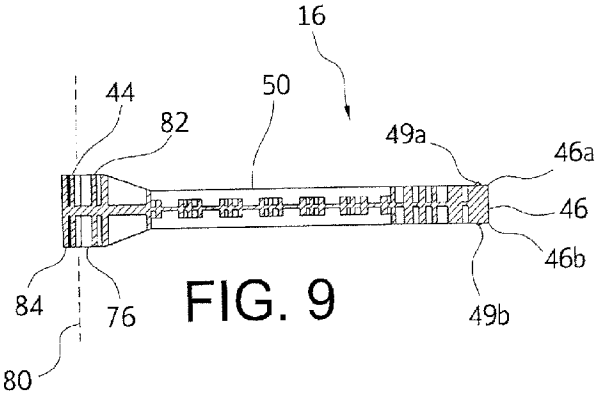
Figure 10:
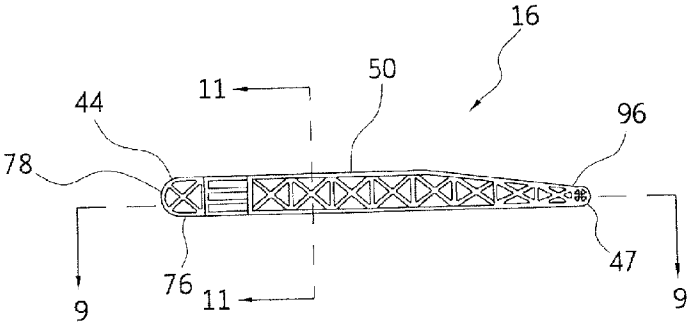
Figure 14:
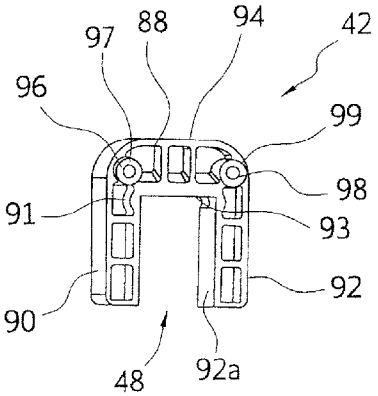
FIGS. 12, 13, 14 and 15 are respectively a side plan view, a bottom plan view, a perspective view and a cross sectional view along the line 15-15 in FIG. 13 of the mounting driver in accordance with the present invention.
Figure 15:
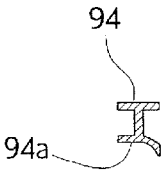
Figure 12:
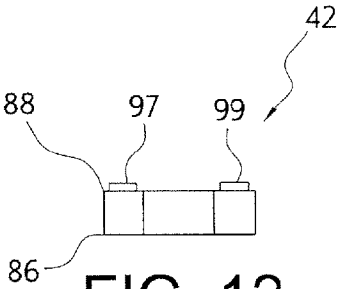
Figure 13:
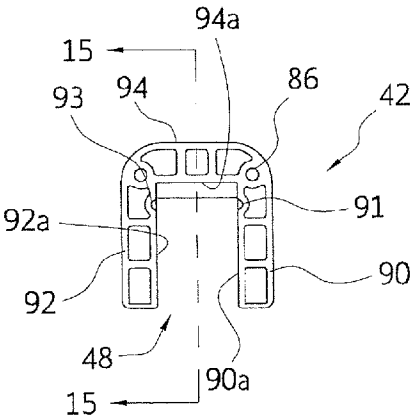

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

With reference to FIGS. 1 to 15, a mounting driver 10 for undermounting a sink 12 to a support surface 14 is disclosed. The mounting driver 10 includes a support bar 16 shaped and dimensioned for positioning between an underside 18 of the sink 12 and a mounting bracket 42 secured to a wall 20 of a cabinet 22 at an angular orientation relative to the wall 20.

As those skilled in the art certainly will appreciate, an undermounted sink 12 is positioned beneath the support surface 14 such that the rim 24 of the sink 12 is hidden beneath the support surface 14. Undermounting is most commonly employed in conjunction with granite countertops, but may be used in conjunction with a variety of surfacing materials within the spirit of the present invention.

With this in mind, and as will be fully appreciated based upon the following disclosure, the countertop, that is, the support surface, 14 includes an upper surface 26 and a lower surface 28, wherein the upper surface 26 is exposed to the external environment and the lower surface 28 faces downwardly, for example, into a cabinet 22 upon which the countertop 14 is mounted. A sink hole 30 is cut within the countertop 14 providing an opening into which the sink 12 is positioned. The sink hole 30 is shaped and dimensioned to substantially conform with the concave bowl 32 of the sink 12 such that the profile of the bowl 32 is aligned with the hole 30 when installation is complete.

As mentioned above, the sink 12 includes a concave bowl 32. The bowl 32 includes an outer circumference 34 from which a sink rim 24 extends. The sink rim 24 is substantially planar and sits within a plane aligned with the upper edge 38 of the concave bowl 32, that is, the outer circumference 34 of the concave bowl 32. As such, the sink rim 24 defines a substantially flat surface which may be positioned along the lower surface 28 of the countertop 14 preferably in the area adjacent the sink hole 30. When properly installed the concave bowl 32 will form a continuous surface with interior wall 40 of the sink hole 30, that is, the exposed portion of the countertop 14 extending between the upper surface 26 and the lower surface 28 when the sink hole 30 is cut in the countertop 14.

As briefly mentioned above, the mounting driver 10 is composed of a support bar 16 and a mounting bracket 42 extends between the underside 25 of the sink rim 24 and the wall 20 of a cabinet 22 upon which the countertop 14 is mounted. Both the support bar 16 and the mounting bracket 42 are preferably injection molded. The support bar 16 is a rigid, elongated member and includes a first end 44 and a second end 46, wherein the mounting bracket 42 is shaped and dimensioned for fixed attachment to the wall 20 of the cabinet 22 so as to support the second end 46 of the support bar 16 when installed in accordance with the present invention. The mounting bracket 42 includes a recess 48 shaped and dimensioned to receive the second end 46 of the support bar 16, such that when the first end 44 of the support bar 16 is pressed against the underside of the sink 12, in particular, the underside 25 of the sink rim 24 when the sink rim 24 is pressed upwardly into contact with the lower surface 28 of the countertop 14, the second end 46 of the support bar 16 is supported by the recess 48 of the mounting bracket 42 rigidly secured to the wall 20 of the cabinet 22 such that all of the downward force of the sink 12 is transferred to the mounting bracket 42 and ultimately the wall 20 of the cabinet 22 to which the mounting bracket 42 is secured.

The support bar 16 is a rigid, elongated member constructed with a trussed cross section increasing the strength and stability thereof. In particular, the support bar 16 includes a central support body 50 having an I-beam construction. That is, the central support body 50, when viewed along a cross sectional plane taken perpendicular to the longitudinal axis extending from the first end 44 of the elongated support bar 16 to the second end 46 of the elongated support bar 16, has a rectangular member 52 with a width 54 and a length 56 as well as a longitudinal axis 57 extending from a first end 58 of the rectangular member 52 to a second end 60 of the rectangular member 52 along the length 56 of the rectangular member 52. The central support body 50 also includes first and second cap members 62, 64 positioned at the first and second ends 58, 60 of the rectangular member 52. Each of the cap members 62, 64 also includes a width 66 and a length 68 as well as a longitudinal axis 70 extending from a first end 72 thereof to a second end 74 thereof wherein the longitudinal axes 70 of the cap members 62, 64 are perpendicular to the longitudinal axis 57 of the rectangular member 52.

Formed at the first end 44 of the support bar 16 is a sink engaging member 76. The sink engaging member 76 includes a curved surface 78 shaped and dimensioned to engage the underside 25 of the rim 24 of the sink 12 without damaging the sink 12. The sink engaging member 76 includes a long axis 80 which is substantially parallel to the longitudinal axes 70 of the cap members 62, 64 discussed above and perpendicular to the longitudinal axis 57 of the central support body 50. With this in mind, the distance from a first end 82 of the sink engaging member 76 to the second end 84 of the sink engaging member 76, that is, along a lateral length dimension substantially parallel to a plane tangent the curved surface 78 of the sink engaging member 76, is greater than the width 54 of the central support body 50.

The support bar 16 is constructed such that a tapered outward transition exists between the central support body 50 and the sink engaging member 76 so as to create the enlarged curved surface 78 of the sink engaging member 76. The enlarged construction of the sink engaging member 76 creates a greater surface area as the support bar 16 engages the underside 25 of the rim 24 of the sink 12. More particularly, and considering the fact that the support bar 16 has a longitudinal axis as it extends from the first end 44 thereof to the second end 46 thereof, the first end 44, that is, the sink engaging member 76, extends laterally outwardly from a plane bisecting the longitudinal axis of the support bar 16. The outward extension is symmetrical with respect to the plane.

As to the second end 46 of the support bar 16, it is consistent in width with the central support body 50 of the support bar 16, but tapers inwardly with respect to the length 56 of the central support body 50 such that it fits within the recess 48 of the mounting bracket 42. In particular, the back surface defined by the cap member 64 is flat from the first end 44 to the second end 46 of the support bar 16 while the front surface defined by the cap member 62 angles toward the back surface as it extends toward the second end 46 of the support bar 16. As with the first end 44, the second end 46 of the support bar 16 includes a rounded distal end 47. It is appreciated the curved surfaces at the first end 44 and the second end 46 of the support bar 16 allow for mounting of the support bar 16 at various angular orientations relative to the wall 20 of the cabinet 22 and the sink 12.

Referring now to the mounting bracket 42, it is substantially U-shaped and, therefore, includes the briefly discussed central recess 48. More particularly, the mounting bracket 42 is of rigid construction and has a substantially planar construction including wall engaging surface 86 and an exposed surface 88. When viewed looking downwardly onto either the wall engaging surface 86 or the exposed surface 88, the mounting bracket 42 includes a first leg 90, a second leg 92, and a connecting member 94 connecting the first leg 90 to the second leg 92. Because of the thickness of the mounting bracket 42 as it extends from the wall engaging surface 86 to the exposed surface 88, each of the first leg 90, the second leg 92, and the connecting member 94, includes an internal side wall 90*a*, 92*a*, 94*a*. The side walls 90*a*, 92*a*, 94*a* of these members respectively define the recess 48 in which the second end 46 of the support bar 16 sits when the device is positioned for supporting a sink 12. In accordance with a preferred embodiment, the side wall 94*a* of the connecting member 94, that is, the side wall 94*a* extending between the first leg 90 and the second leg 92, has a concave surface with a rounded profile matching the rounded distal end 47 at the second end 46 of the support bar 16. This round, concave surface forces the second end 46 of the support bar 16 into the concavity thereof during installation and prevents inadvertent dislodging of the support bar 16 from the mounting bracket 42 after installation.

Dislodgement is prevented and installation is enhanced by the provision of mating recesses 91, 93 and protrusions 49*a*, 49*b* respectfully provided on the side walls 90*a*, 92*a* of the first and second legs 90, 92 and the lateral edges 46*a*, 46*b* formed at the second end 46 of the support bar 16. In particular, when the second end 46 of the support bar 16 is positioned within the recess 48 of the mounting bracket 42, the rounded distal end 47 sits within the concave side wall 94*a*, while the protrusions 49*a*, 49*b* at the second end 46 of the support bar 16 snap into the pivot recesses 91, 93 of the side walls 90*a*, 92*a* of the first and second legs 90, 92. With this mating arrangement the second end 46 of the support bar 16 is frictionally held with the recess 48 and permitted to pivot relative thereto in a manner enhancing installation at various orientations.

The mounting bracket 42 also includes screw holes 96, 98 laterally extending therethrough, that is, from the exposed surface 88 to the wall engaging surface 86, for the passage of mounting screws 100 in accordance with the usage of the present invention. The screw holes 96, 98 are further provided with extending lips 97, 99 assisting in controlling the penetration of the screws upon installation. In accordance with a preferred embodiment, a first aperture 96 is formed in the base of the first leg 90, that is, adjacent the meeting point of the first leg 90 and the connecting member 94 and a second aperture 98 is formed in the base of a second leg 92, that is, adjacent the meeting point of the second leg 92 and the connecting member 94. The positioning of the apertures 96, 98, and the screws 100 associated therewith, is selected so as to optimize the distribution of forces when the mounting driver 10 is properly positioned for supporting a sink 12.

In practice, the sink 12 is held in position along the lower surface 28 of the countertop 14 with the rim 24 in alignment with the sink hole 30. The second end 46 of the support bar 16 is then snapped into the recess 48 of the mounting bracket 42. With the support bar 16 and mounting bracket 42 as a single unit, the first end 44 of the mounting driver 10 is pressed into engagement with the underside 25 of the rim 24. Upward pressure is applied to the mounting driver 10 with the mounting bracket 42 held against the wall 20 of the cabinet. Once the mounting driver 10 is positioned properly and adequate upward pressure is applied, screws 100 are passed through the screw holes 96, 98 and into the wall 20 of the cabinet 22. With the screws 100 applied, attachment is complete. It is appreciated that washers may be used in conjunction with the screws where deemed necessary and additional structural support may be incorporated to the installation process where the wall of the cabinet or other surface is not considered adequate to support the weight of the sink.

With the second end 46 of the support bar 16 securely positioned within the recess 48, the first end 44 in engagement with the under surface of the sink 12, and the mounting bracket 42 fixedly attached to the wall 20 of the cabinet 22, the weight of the sink 12 forces the second end 46 into the mounting bracket 42, which is supported by the screws 100 and the wall 20 of the cabinet 22, and creates a secure supporting structure for the sink 12. Multiple support mounting drivers 10 may be positioned at various locations about the circumference of the sink 12 to ensure proper support thereof.

It is appreciated the present mounting driver may be used in supporting both newly installed sinks and those sink which have been previously installed but require additional support due to the failure of the previously used mounting structure.

Figure 18:
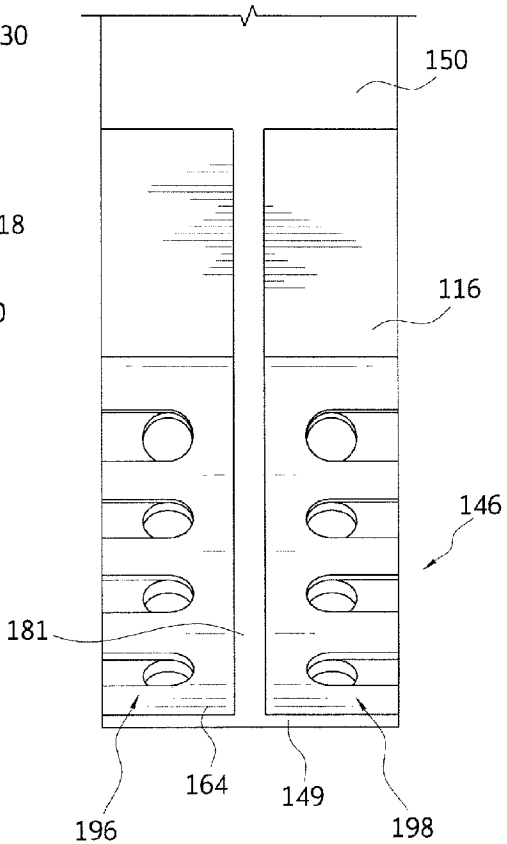
FIGS. 16, 17 and 18 are respectively a perspective view, a side view and a detailed plan view of a mounting driver in accordance with an alternate embodiment.
Figure 17:
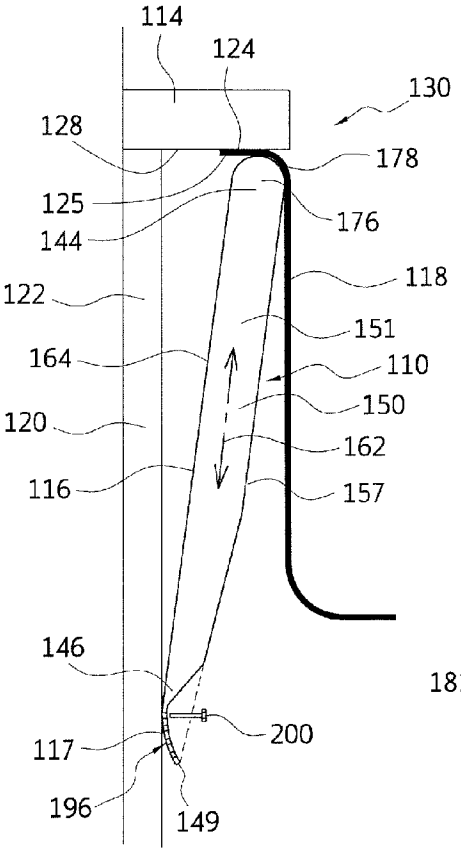
Figure 16:
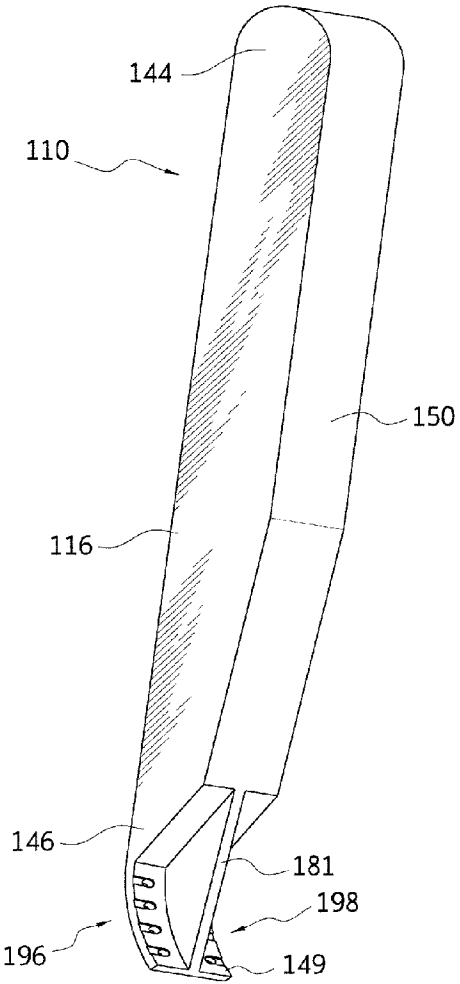

It is also contemplated the mounting driver 110 may be constructed in a one-piece manner as shown with reference to FIGS. 16 to 18. In accordance with such an embodiment, the mounting driver 110 includes a support bar 116 shaped and dimensioned for positioning between an underside 118 of the sink 112, wherein the support bar includes an arcuate mounting surface 117 adapted for direct attachment to the wall 120 of a cabinet 122 at an angular orientation relative to the wall 120.

As with the prior embodiment, the support bar 116 is a rigid, elongated member and includes a first end 144 and a second end 146. As with the prior embodiment, the support bar is preferably injection molded. The support bar 116 in accordance with this embodiment only exhibits a trussed cross sectional construction in the areas of the first end 144 and the central support body 150. In particular, and as with the prior embodiment, the support bar 116 includes a central support body 150 having an I-beam construction as described above with regard to the embodiment of FIGS. 1-15. As such, the support bar 116 includes a back surface cap member 164 defining the back side of the support bar 116 and a front surface cap member 162 defining the front side of the support bar 116 with supporting internal structure 151 formed therebetween.

The support bar 116 also includes a sink engaging member 176 formed at the first end 144 of the support bar 116. As with the embodiment disclosed above with reference to FIGS. 1-15, the sink engaging member 176 includes a curved surface 178 shaped and dimensioned to engage the underside 125 of the rim 124 of the sink 112 without damaging the sink 112. The sink engaging member 176 also includes a long axis which is substantially perpendicular to the longitudinal axis 157 of the central support body 150. With this in mind, and as with the embodiment described above with reference to FIGS. 1-15, the distance from a lateral first end of the sink engaging member 176 to the lateral second end of the sink engaging member 176 is greater than the width of the central support body 150.

The support bar 116 is constructed such that a tapered outward transition exists between the central support body 150 and the sink engaging member 176 so as to create the enlarged curved surface 178 of the sink engaging member 176. The enlarged construction of the sink engaging member 176 creates a greater surface area as the support bar 116 engages the underside 125 of the rim 124 of the sink 112. More particularly, and considering the fact that the support bar 116 has a longitudinal axis as it extends from the first end 144 thereof to the second end 146 thereof, the first end 144, that is, the sink engaging member 176, extends laterally outwardly from a plane bisecting the longitudinal axis of the support bar 116. The outward extension is symmetrical with respect to the plane.

As to the second end 146 of the support bar 116, it is consistent in width with the central support body 150 of the support bar 116, but exhibits a curvature as it extends from the central support body 150 to the distal end 149 of the support bar 116 at the second end 146 thereof. In particular, the back side defined by the back surface cap member 164 is flat from the first end 144 of the support bar 116 to the central support body 150 of the support bar 116, but exhibits a curved surface at the second end 146 of the support bar 116. As to the front side defined by the front surface cap member 162, as well as the central trussed supporting structure 163 between the back surface cap member 164 and the front surface cap member 162, they end at the point 165 where the central support body 150 turns into the second end 146 of the support bar 116. The removal of this structure at this point allows for access to the back surface cap member 164, from the front side of the mounting driver 110, as will be appreciated based upon the following disclosure.

More particularly, the second end 146 of the support bar 116 is curved such that the back surface cap member 164 defines a concave surface 167 along the back side 116*b* of the support bar 116. This back surface cap member 164 is ultimately shaped and dimensioned for positioning along the wall 120 of the cabinet 122 during the installation process.

In particular, the concave surface 167 has a radius of curvature. The concave surface 167 extends about a central point through which a second end central axis 171 normal to the plane symmetrically bisecting the second end 146 extends.

Extending through the back surface cap member 164 are two sets of holes 196, 198 formed along the length of the second end 146 of the support bar 116 allowing the second end 146 of the support bar 116 to function as a mounting bracket. These holes 196, 198 allow for various angular orientations of the support bar 116 during installation while simultaneously permitting an installer to drive the screws 200 straight into the wall 120 of the cabinet 122 (or other support structure).

As discussed above, the front surface cap member 162 defining the front side of the support bar 116 ceases as the central support body 150 transitions into the second end 146 of the support bar 116. As such, the second end 146 is not constructed with the same truss construction employed with the first end 144 and the central support body 150. Rather, the second end 146 of the support bar 116 includes a support beam 181 extending along the second end 146 of the support bar 116 from the central support body 150 to the distal end 149 of the support bar 116 at the second end 146 thereof. The support beam 181 bisects the back surface cap member 164 and lies in a plane that is perpendicular to the back side of the support bar 116 surface defined by the back surface cap member 164. As such, and considering the first and second sets of holes 196, 198 discussed above, the first set of holes 196 is positioned on one side of the support beam 181 and the second set of holes 198 is positioned on the other side of the support beam 181. While a series of spaced holes are disclosed in accordance with a preferred embodiment, it is appreciated a slot might also be employed to provide for versatility in the positioning of the support arm during installation.

In practice, the sink 112 is held in position along the lower surface 128 of the countertop 114 with the rim 124 in alignment with the sink hole 130. The first end 144 of the mounting driver 110, that is, the support bar 116, is pressed into engagement with the underside 125 of the rim 124. Upward pressure is applied to the mounting driver 110 with the second end 146 of the support bar 116 held against the wall 120 of the cabinet 122.

The ability to secure the first end 144 of the support bar 116 to the underside 125 of the rim 124 at various angular orientations while the second end 146 of the support bar is held against the wall 120 of the cabinet 122, is facilitated by relationship between the curved concave surface 167 at the back side 116*b* of the support bar 116 at the second end thereof and the curved surface 178 of the sink engaging member 176. In particular, because the second end central axis is parallel to a first end central axis about which the curved surface 178 of the first end 144 extends, the support bar 116 may be oriented at a wide variety of angles during installation allowing for use in a variety of different cabinet and sink arrangements.

Once the mounting driver 110 is positioned properly and adequate upward pressure is applied, screws 200 are passed through the selected screw holes 196, 198 and into the wall 120 of the cabinet 122. It is appreciated the preferred screw holes 196, 198 will be those allowing for the perpendicular application of a screw 200 into the wall 120 of the cabinet 122. With the screws 200 applied, attachment is complete. It is appreciated that washers may be used in conjunction with the screws where deemed necessary and additional structural support may be incorporated to the installation process where the wall of the cabinet or other surface is not considered adequate to support the weight of the sink.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A one-piece mounting driver for undermounting a sink to a support surface, comprising:

a support bar shaped and dimensioned for positioning between an underside of the sink and a wall of a cabinet at an angular orientation relative to the wall, the support bar including a first end having a sink engaging member with a curved surface shaped and dimensioned to engage the underside of the sink and a second end with a central support body therebetween;

the second end of the support bar includes a support beam extending therealong from the central support body to a distal end and a back surface cap member, the support beam lying in a plane that is perpendicular to a back side of the support bar surface as defined by the back surface cap member, wherein the back surface cap member is curved such that the back surface cap member of the support bar defines a concave surface along the back side of the support bar, and extending through the back surface cap member are a plurality of screw holes formed along the length of the second end of the support bar for the passage of a mounting screw;

wherein with the first end of the support bar pressed against the underside of the sink, the second end of the support bar is rigidly secured to the wall of the cabinet.

2. The mounting driver according to claim 1, wherein the support bar is an elongated member including a central support body and the first end of the support bar includes a sink engaging member including a curved surface shaped and dimensioned to engage the underside of the sink.

3. The mounting driver according to claim 2, wherein the second end also includes a support beam extending perpendicular to the back surface cap member.

4. The mounting driver according to claim 1, wherein the support beam bisects the back surface cap member and lies in a plane that is perpendicular to the back side of the support bar surface defined by the back surface cap member.

5. The mounting driver according to claim 4, wherein screw holes are positioned on opposite sides of the support beam.

6. The mounting driver according to claim 1, wherein the sink engaging member includes a long axis which is substantially perpendicular to a longitudinal axis of the central support body and a distance from a lateral first end of the sink engaging member to a lateral second end of the sink engaging member is greater than a width of the central support body.

7. The mounting driver according claim 6, wherein the support bar is constructed such that a tapered outward transition exists between the central support body and the sink engaging member so as to create an enlarged curved surface member providing a greater surface area as the support bar engages an underside of a rim of the sink.

8. A one-piece mounting driver for undermounting a sink to a support surface, comprising:

a support bar shaped and dimensioned for positioning between an underside of the sink and a wall of a cabinet at an angular orientation relative to the wall, the support bar including a first end having a sink engaging member with a curved surface shaped and dimensioned to engage the underside of the sink and a second end with a central support body therebetween;

the second end of the support bar includes a support beam extending therealong from the central support body to a distal end and a back surface cap member, the support beam lying in a plane that is perpendicular to a back side of the support bar surface as defined by the back surface cap member, and extending through the back surface cap member are a plurality of screw holes formed along the length of the second end of the support bar for the passage of a mounting screw;

wherein with the first end of the support bar pressed against the underside of the sink, the second end of the support bar is rigidly secured to the wall of the cabinet.

9. The mounting driver according to claim 8, wherein the support bar is an elongated member including a central support body and the first end of the support bar includes a sink engaging member including a curved surface shaped and dimensioned to engage the underside of the sink.

10. The mounting driver according to claim 9, wherein the second end also includes a support beam extending perpendicular to the back surface cap member.

11. The mounting driver according to claim 8, wherein the support beam bisects the back surface cap member and lies in a plane that is perpendicular to the back side of the support bar surface defined by the back surface cap member.

12. The mounting driver according to claim 11, wherein screw holes are positioned on opposite sides of the support beam.

13. The mounting driver according to claim 8, wherein screw holes are positioned on opposite sides of the support beam.

14. The mounting driver according to claim 8, wherein the sink engaging member includes a long axis which is substantially perpendicular to a longitudinal axis of the central support body and a distance from a lateral first end of the sink engaging member to a lateral second end of the sink engaging member is greater than a width of the central support body.

15. The mounting driver according claim 14, wherein the support bar is constructed such that a tapered outward transition exists between the central support body and the sink engaging member so as to create an enlarged curved surface member providing a greater surface area as the support bar engages an underside of a rim of the sink.

16. A one-piece mounting driver for undermounting a sink to a support surface, comprising:

a support bar shaped and dimensioned for positioning between an underside of the sink and a wall of a cabinet at an angular orientation relative to the wall, the support bar including a first end having a sink engaging member with a surface shaped and dimensioned to engage the underside of the sink and a second end with a central support body therebetween;

the central support body being of an I-beam construction which, when viewed along a cross sectional plane taken perpendicular to a longitudinal axis extending from the first end of the support bar to the second end of the support bar, has a rectangular member and first and second cap members positioned at first and second ends of the rectangular member;

the second end of the support bar is angularly oriented relative to the central support body, and extending through the second end of the support bar are a plurality of screw holes formed along the length of the second end of the support bar for the passage of a mounting screw;

wherein with the first end of the support bar pressed against the underside of the sink, the second end of the support bar is rigidly secured to the wall of the cabinet.

17. The mounting driver according to claim 16, wherein the sink engaging member includes a curved surface shaped and dimensioned to engage the underside of the sink.

18. The mounting driver according to claim 16, wherein the second end also includes a support beam extending perpendicular to the back surface cap member.

19. The mounting driver according to claim 18, wherein the support beam bisects the back surface cap member and lies in a plane that is perpendicular to the back side of the support bar surface defined by the back surface cap member.

20. The mounting driver according to claim 19, wherein screw holes are positioned on opposite sides of the support beam.

* * * * *